US006354555B1

(12) United States Patent
Nishizuka et al.

(10) Patent No.: US 6,354,555 B1
(45) Date of Patent: Mar. 12, 2002

(54) DEVICE FOR FITTING OUTDOOR UNIT OF SEPARATE TYPE AIR CONDITIONER

(75) Inventors: Toshiharu Nishizuka, Kyoto; Koji Hatano, Otsu; Mitsuo Nakanuma, Shiga, all of (JP)

(73) Assignee: Matsushita Electric Industrial, Co., Ltd., Osaka (JP)

( * ) Notice: Subject to any disclaimer, the term of this patent is extended or adjusted under 35 U.S.C. 154(b) by 0 days.

(21) Appl. No.: 09/171,594

(22) PCT Filed: Feb. 20, 1998

(86) PCT No.: PCT/JP98/00724

§ 371 Date: Oct. 21, 1998

§ 102(e) Date: Oct. 21, 1998

(87) PCT Pub. No.: WO98/37368

PCT Pub. Date: Aug. 27, 1998

(30) Foreign Application Priority Data

Feb. 21, 1997 (JP) ..... 9-37395

(51) Int. Cl.[7] ..... F16H 13/00
(52) U.S. Cl. ..... 248/544; 248/674; 62/262
(58) Field of Search ..... 248/544, 561, 248/551, 674, 208, 68.1, 58; 62/298, 262; 165/47

(56) References Cited

U.S. PATENT DOCUMENTS 1,007,138 A * 10/1911 Peirce ..... 248/58 X
3,491,549 A * 1/1970 Oglesby ..... 62/262
3,554,476 A * 1/1971 Gaylor, Jr. ..... 248/208
4,056,250 A * 11/1977 Uchiyama ..... 248/14
4,097,012 A * 6/1978 McIntyre ..... 248/23
5,582,025 A * 12/1996 Dubin et al. ..... 62/262
5,640,301 A * 6/1997 Roecker et al. ..... 361/686
6,145,334 A * 11/2000 Mochizuki et al. ..... 62/262

FOREIGN PATENT DOCUMENTS

| | | |
|---|---|---|
| JP | S54-163049 | 5/1978 |
| JP | 58-119166 | 8/1983 |
| JP | 63-185026 | 11/1988 |

* cited by examiner

*Primary Examiner*—Leslie A. Braun
*Assistant Examiner*—Gwendolyn Baxter
(74) *Attorney, Agent, or Firm*—Ratner & Prestia, P.C.

(57) ABSTRACT

A unit installation tool facilitates installation of a unit of a separate type air conditioner on a vertical member, preventing exposure of conduit to the elements, and improves the appearance. The tool has a yoke fitted to the vertical member with bolts, and a support part extended forward from the yoke, for mounting the upper part of the back side of the unit on its leading end. The mounted unit is supported at an upward position by a specified extent from the support part. A conduit space is formed on the support port between the supported outdoor unit and the yoke or the vertical member on which it is mounted.

24 Claims, 6 Drawing Sheets

1 ··· Installation tool
2 ··· Outdoor unit
17 ··· Bolt
21 ··· Back side
22 ··· Upper part of back side
25 ··· Ceiling plate
a ··· Piping
b ··· Wiring
C ··· Outer wall

DEVICE FOR FITTING OUTDOOR UNIT OF SEPARATE TYPE AIR CONDITIONER

This Application is a U.S. National Phase Application of PCT International Application PCT/JP98/00724.

TECHNICAL FIELD

The present invention relates to a unit installation tool for installing a unit (such as an air conditioner) to a vertical surface (such as a wall).

BACKGROUND ART

As shown in FIG. 8, an outdoor unit 51 of an individual type air conditioner accommodates many component devices, i.e. a heavy compressor 53 and other components in a box 52. Thus is done in order to decrease the number of components of the indoor unit (not shown) and to reduce the indoor units weight and size. Accordingly, the outdoor unit 51 is heavier than the indoor unit, and hence generally it is installed on a bench placed on the ground, verandah or roof, by making use of mounting bases 54 attached to the bottom. The mounting base 54 has a mounting hole 54*a* to the bench, and is bolted firmly. Depending on the case, however, if there is no space for placing the bench, the outdoor unit 51 is installed on the wall surface.

In such installation, hitherto, a stand 56 having a mounting part 55 to be mounted on the wall as shown in FIG. 8 is used.

However, in such a conventional method of installation, the stand 56 has mounting holes 56*a* corresponding to mounting holes 54*a* of the mounting bases 54 of the outdoor unit 51, and corresponding bolts 58 passing in them and nuts 59 to be engaged with these bolts 58 are tightened to provide support. Such a job is done, however, on an elevated place, and the mounting holes 54a at the heavy outdoor unit 51 side are desirably precisely aligned to the mounting holes 56*a* of the stand 56. Accordingly, this job is accompanied by heavy labor and is slow in progress. Or, when installing the outdoor unit 51 on a place remote from the ground, such as the wall of a high-rise building, a scaffold must be erected prior to installation, or the outdoor unit 51 must be lifted and suspended by a rope or the like, while such complicated job is done, which required much labor. If, by stretching out hands from the window, if the stand 56 can be mounted on the wall of the building beneath the window, since the installation job of the outdoor unit 51 on the stand 56 is mainly done in the bottom of the outdoor unit 51, the worker must go out of the window to reach beneath or ahead of the outdoor unit 51.

In order to do the installation job from within the window A, as shown in FIG. 5 to FIG. 7, it may be considered to use a hooking tool 42 having a mounting part 43 to the window opening B and a holding part 44 of the outdoor unit 41 extended laterally. That is, by mounting this hooking tool 42 on the window opening B by using bolts 49, in the holding part 44 of the hooking tool 42, an engaging part 46 provided in the upper part of the back side of the outdoor unit 41 is engaged from above to support it from beneath, and a rubber spacer 47 preliminarily adjusted in length in the longitudinal direction provided in the lower part of the back side 21 of the outdoor unit 41 in order to absorb vibration is fitted to the wall C to be stabilized. In such constitution, the installation is easy, and also by the vibration absorbing performance of the spacer 47 on the wall C, transmission of vibration of the outdoor unit 41 to the wall can be suppressed. Moreover, by mutually coupling tightening parts 45 provided at right and left sides of the holding part 44, and a tightening part 48 of the outdoor unit 41 side corresponding to the tightening parts 45 with bolts 50, it may be considered to install so that the engaging part 46 of the outdoor unit 41 may not be detached from the holding part 44.

However, when connecting the piping or wiring with the indoor unit after installing the outdoor unit 41 on the wall, depending on the place of installing the outdoor unit 41, if it is necessary to distribute the conduit (e.g. wiring or piping) to the right and left side of the outdoor unit 41, with this hooking tool 42, since the outdoor unit 41 is merely installed on the wall C, the piping or wiring is exposed above or beneath the outdoor unit 41. Therefore, it is exposed to rain and wind, and the appearance is spoiled.

Or, when using the hooking tool 42, during long-time use, the rubber-made spacer 47 deteriorates or deforms, and the action of suppressing transmission of vibration of the outdoor unit 41 to the wall C is lowered.

SUMMARY OF THE INVENTION

The invention relates to an outdoor unit installation tool for installing a unit such as a separate type air conditioner on a vertical member. An exemplary application is installing an outdoor unit of an individual air conditioner on a wall. The tool comprises a yoke fitted to the wall with bolts, and a support part extended forward from the yoke, for mounting the upper part of the back side of the outdoor unit on its leading end, in which the mounted outdoor unit is supported at an upward position by a specified extent from the support part, and a wiring and/or piping space is formed on the support part between the supported outdoor unit and the yoke or the wall on which it is mounted.

By first fitting this installation tool to a specified position of the wall at the yoke by using bolts, and then supporting the mounting part at the back side of the outdoor unit at the support part, the outdoor unit can be easily installed on a specified position of the wall. Later, if necessary to distribute the piping or conduit (e.g. wiring) to the right and left side of the outdoor unit, without exposing the piping or wiring above or beneath the outdoor unit in the appearance from the front side, it can be distributed in the piping and/or wiring space behind the outdoor unit. As a result, exposure of piping or wiring to rain and wind is lessened, and the appearance is improved.

In the constitution combined with a ceiling plate for covering the upper part of the piping and/or wiring space, since the range within the piping or wiring space is covered, exposure of piping or wiring to rain and wind is lessened more effectively, and the appearance from above is further improved.

In the constitution of using the ceiling plate which also covers above the outdoor unit, without increasing the number of parts or number of steps, the same effect and action as above are obtained.

In the constitution of disposing a recess for forming a space against the wall at the back side of the bolting portion of the yoke, the yoke is fitted to the wall with an elastic pressing force having a necessary pressing force by bolting and a low elasticity in the space formed against the wall. Accordingly, without using a rubber spacer, transmission of vibration of the outer unit supported on the support part to the indoor side through the wall can be reduced. Further, as compared with the use of rubber spacer or the like, this effect can be maintained for a longer period.

DETAILED DESCRIPTION

Figure 1:
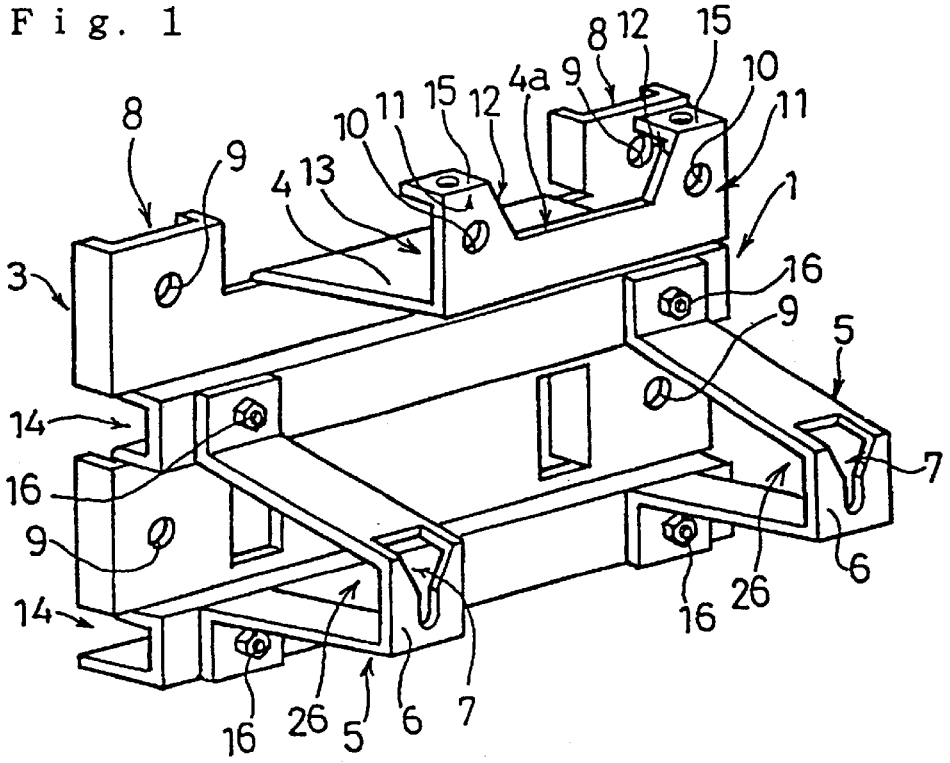
FIG. 1 is a perspective view showing an exemplary embodiment a unit installation tool of a separate type air conditioner in accordance with an exemplary of the present invention.

An exemplary embodiment of the invention is described below while referring to the drawings.

An exemplary embodiment of an outdoor unit installation tool for a separate type air conditioner in accordance with the invention is shown in FIG. 1 and comprises a yoke 3 fitted to the vertical member (e.g. wall) with bolts, a first support part 4 having the upper part of the yoke 3 projected forward, folded upward, and extended laterally, and a pair of right and left second support parts 5 having the base portion fastened with bolts 16 to the front side of the yoke 3 beneath the first support part 4.

Figure 3:
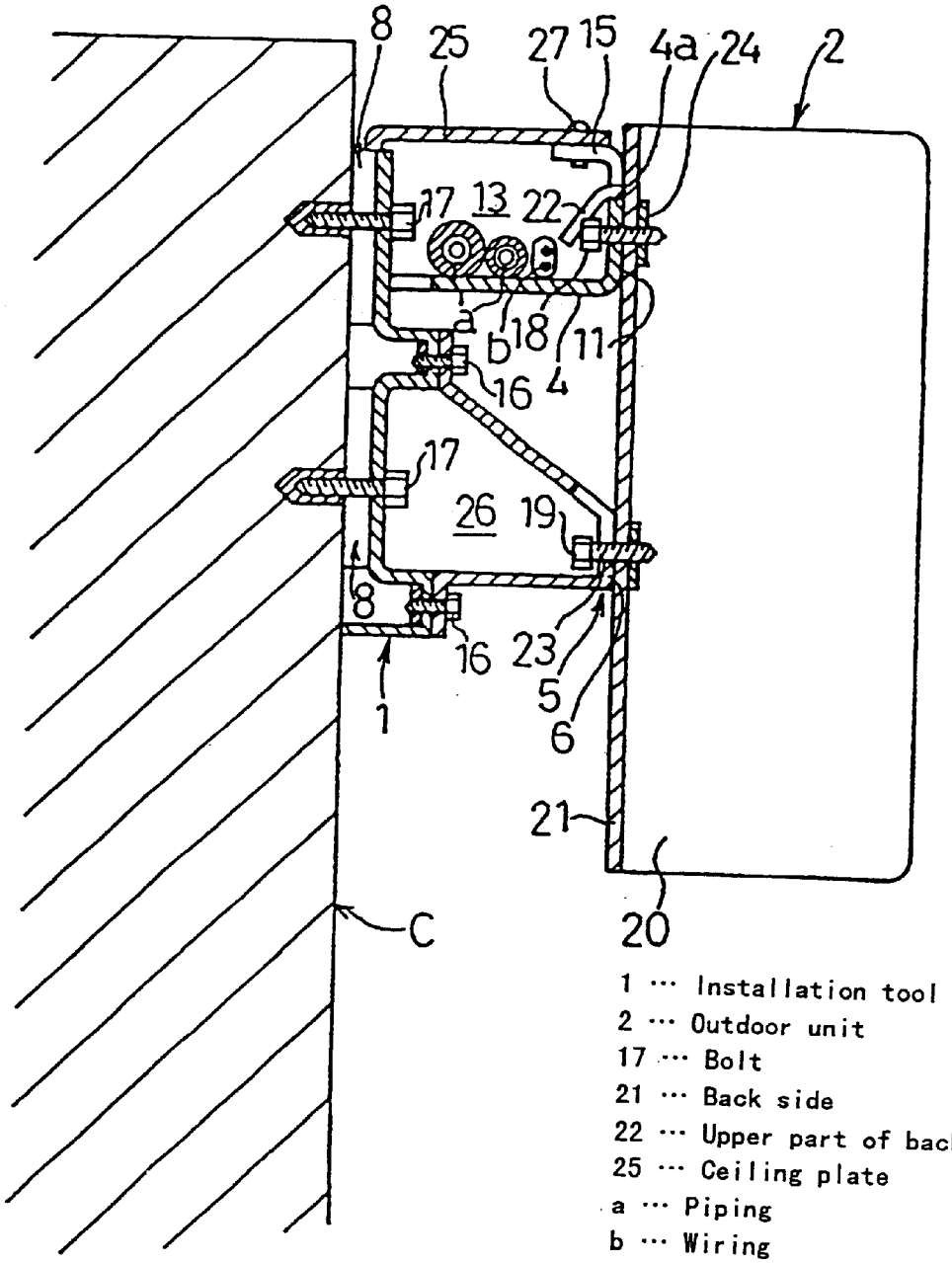
FIG. 3 sectional view showing a mode of use of the unit installation tool.

An example of unit 2 is shown in FIG. 3, which comprises a first mounting part 22 provided integrally in the upper part of a back side 21 of its box 20 and released downward, and a second mounting part 23 composed of a bolt 19 spirally fitted to the back side 21 beneath the first mounting part 22.

The unit 2 accommodates compressor and other heavy objects (not shown) in the box 20. The first mounting part 22 in the upper part of the back side 21 of the box 20 supports the whole weight of the unit 2. To satisfy this requirement, in the exemplary embodiment, the first mounting part 22 is formed integrally in the upper part of a relatively thick back plate fitted to the back side 21 of the box 20. Not limited to this, however, the first mounting part 22 may be preliminarily provided in the upper part of the back side 21 of the box 20 by other mounting means. At the back side 21, a nut 24 is provided for tightening the outdoor unit 2 to the installation tool 1 near the first mounting part 22.

The installation tool 1 is designed to, as shown in FIG. 3, install the unit 2, for example, on the wall C beneath the window C.

The yoke 3 forms four wall mounting holes 9 in the upper, lower, right and left positions, and is attached to the wall C beneath the window within hands reach from the window with four bolts 17. Channels 14 are formed by a plate bending process. The heads of the bolts mounting the second support part 5 are accommodated in the channels 14 so as to play the role of the reinforcing ribs for reinforcing the yoke 3. Moreover, the metal plate is folded backward to form a recess 8 for forming a space against the wall C provided behind near the wall mounting holes 9. As the yoke 3 is fitted with an elastic pressing force having a necessary pressing force to the wall C and a low elasticity, transmission of vibration of the outdoor unit 2 to the wall C is reduced.

The first support part 4 has the upper part of the yoke 3 extended forward and folded upward. Between the outdoor unit 2 supported by this first support part 4 and the yoke 3 or the wall C on which it is mounted, a piping and wiring space 13 is formed for distributing piping "a" and/or wiring "b". The upper side 4*a* folded upward and extended laterally is engaged with a first mounting part 22 from above to support the whole weight of the outdoor unit 2 by receiving it from beneath, and it is engaged with the first mounting part 22 to limit the move of the first mounting part 22 in the longitudinal direction.

Outward of the right and left sides of the first support part 4, metal plates are extended further above the first support part 4 to form coupling parts 11, 11. Inside of these coupling parts 11, 11, a pair of right and left lateral guides 12, 12 for positioning the first mounting part 22 in the lateral direction are formed. In the engaging operation, therefore, the first mounting part 22 is received easily and positioned precisely, and it is designed to assure support in a necessary range. In the center of each coupling part 11, a coupling hole 10 is penetrating, and an operation space for inserting a bolt 18 through the coupling hole 10, and coupling this bolt to the nut 24 of the outdoor unit 2 is provided at right and left sides of the piping and wiring space 13. Further, at the upper end of each coupling part 11, a ceiling plate mounting part 15 is extended as being folded backward, and, as shown in FIG. 3, it is designed to fix with screws 27 a ceiling plate 25 for covering the distribution range of the piping "a" and wiring "b" in the piping and wiring space 13 between the right and left ends of the outdoor unit 2. However, the location of the coupling parts 11 and ceiling plate mounting part 15 is not limited in the upper area of the right and left sides of the first support part 4. Still more, they may not be necessarily extended from the first support part 4. Incidentally, the ceiling plate 25 may be formed integrally with the installation tool 1. In such a case, however, the working efficiency is not satisfactory in the engaging operation of the outdoor unit 2 with the installation tool 1 or in the piping and wiring work.

Figure 2:
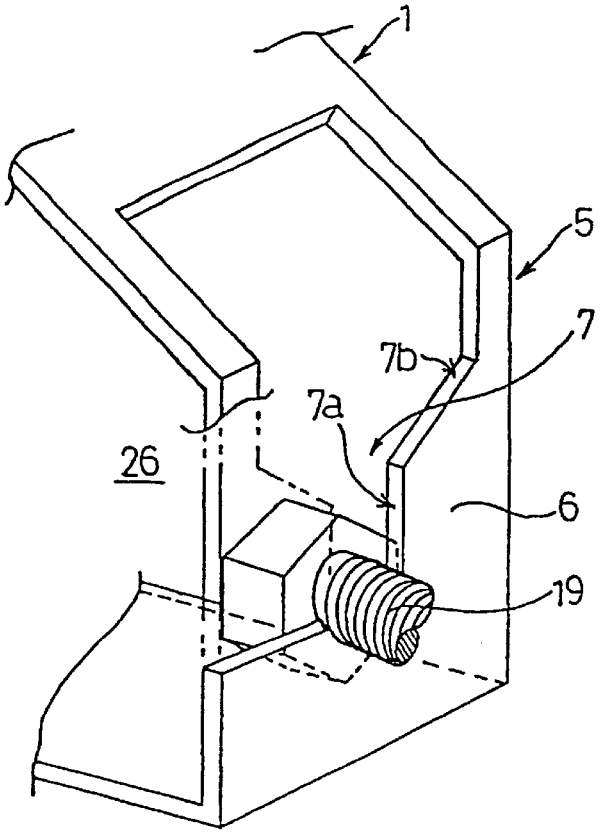
FIG. 2 is a partially magnified perspective view of FIG. 1.

The second support part 5 consists of a pair of right and left metal plates having the base portion fastened to the front side of the yoke 3 with bolts 16, and a pair of right and left parts are provided so as to be positioned beneath the first support part 4 and outward at right and left ends. Each end has a support plate 6 projecting to each front side and abutting against the back side 21 of the outdoor unit 2. In the operation of installing the unit 2 from above, it is designed so that the bolt 19 of the second mounting part 23 may not interfere with the first support part 4. The support plate 6 has a notch 7 extended upward and laterally, and an operation space 26 for stopping the notch 7 and the second mounting part 23 of the outdoor unit 2 against the wall C with bolts 19. The notch 7 includes, as shown in the magnified view in FIG. 2, a U-shaped notch 7*a* having a lateral width slightly larger than the axial diameter of the bolt 19, and a guide 7*b* extended upward and laterally from the upper end of this U-shaped notch 7*a*. It is therefore easier to install from above the bolt 19 by the guide 7*b*. In the U-shaped notch 7*a*, as the front and back sides of the support plate 6 are held between the head of the bolt 19 and the back side 21 of the outdoor unit 2, the longitudinal move of the lower side of the outdoor unit 2 is defined. Further, as the U-shaped notch 7*a* holds the shaft of the bolt 19 from right and left sides, the outdoor unit 2 is positioned precisely in the lateral direction. By tightening the bolt 19, moreover, the lower side of the outdoor unit 2 is fixed to the installation tool 1, and hence the installation of the outdoor unit 2 is stronger.

By the constitution of the installation tool 1, first by fitting this installation tool 1 to a specified position of the wall C at the yoke 3 by using bolts 17, then by engaging the first support part 4 and second support part 5 provided in the upper and lower parts of the yoke 3 with the first mounting part 22 and second mounting part 23 in the upper and lower parts of the back side 21 of the outdoor unit 2 simultaneously from above, it is possible to install tool 1 easily in a support state while satisfying both the necessary support rigidity and the deflection preventive rigidity in the fitting plane direction at the lower side of the outdoor unit 2 and in the longitudinal direction. Later, if necessary to distribute the piping a or wiring b to the right and left side of the outdoor unit 2, without exposing the piping a or wiring b above or beneath the outdoor unit 2 in the appearance from the front side, it can be distributed in the piping and wiring space 13 behind the outdoor unit 2. As a result, the appearance of piping a or wiring b is improved. Moreover, when the ceiling plate 25 is attached to the upper part of the piping and wiring space 13 after piping and wiring connection, the appearance from above is also improved. Also, effects of rainfall are lessened in the yoke 3 and the support parts 4, 5 where rainfall is likely to gather.

Figure 4:
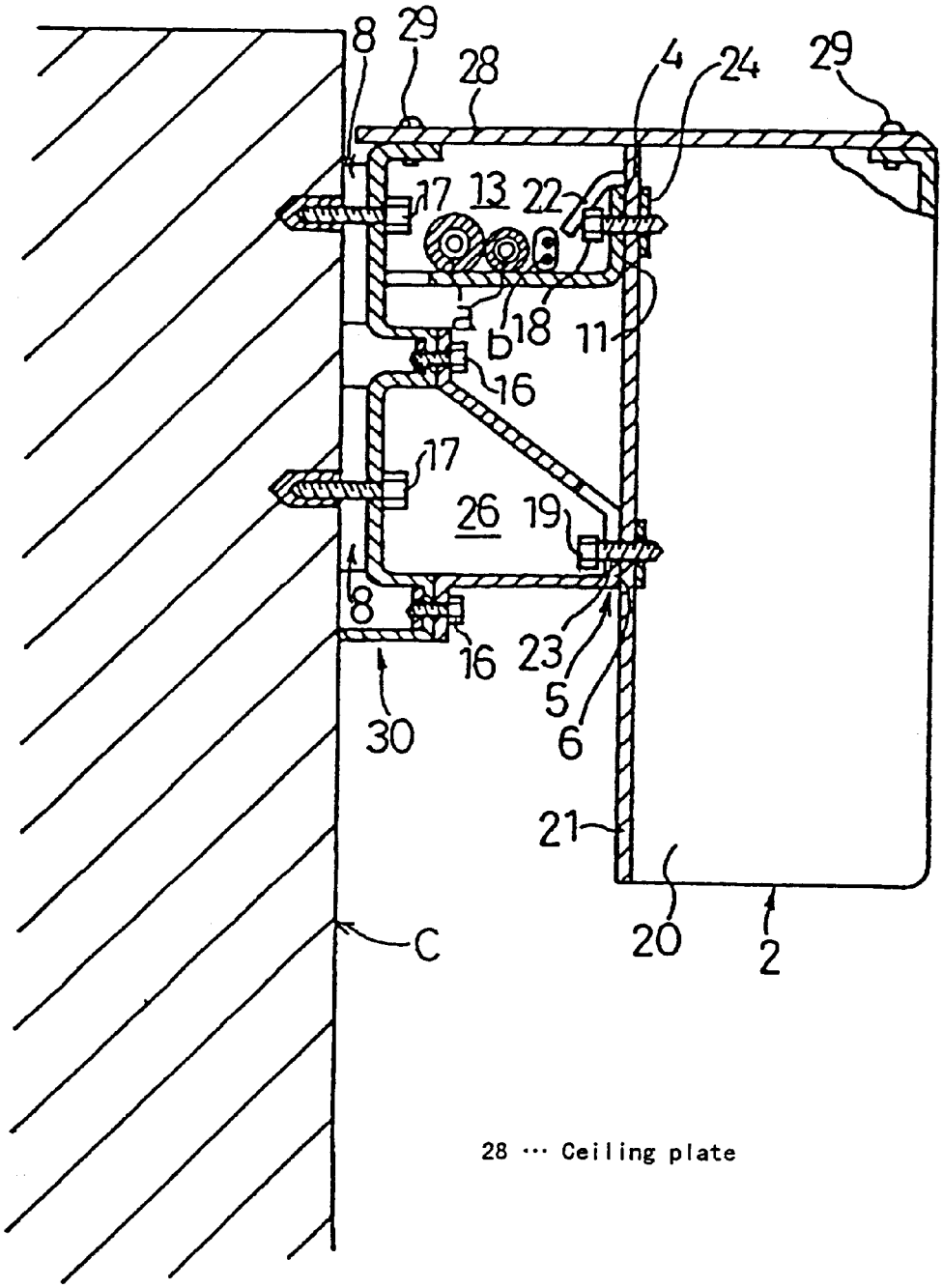
FIG. 4 is a sectional view showing a further exemplary embodiment of the invention.
Figure 5:
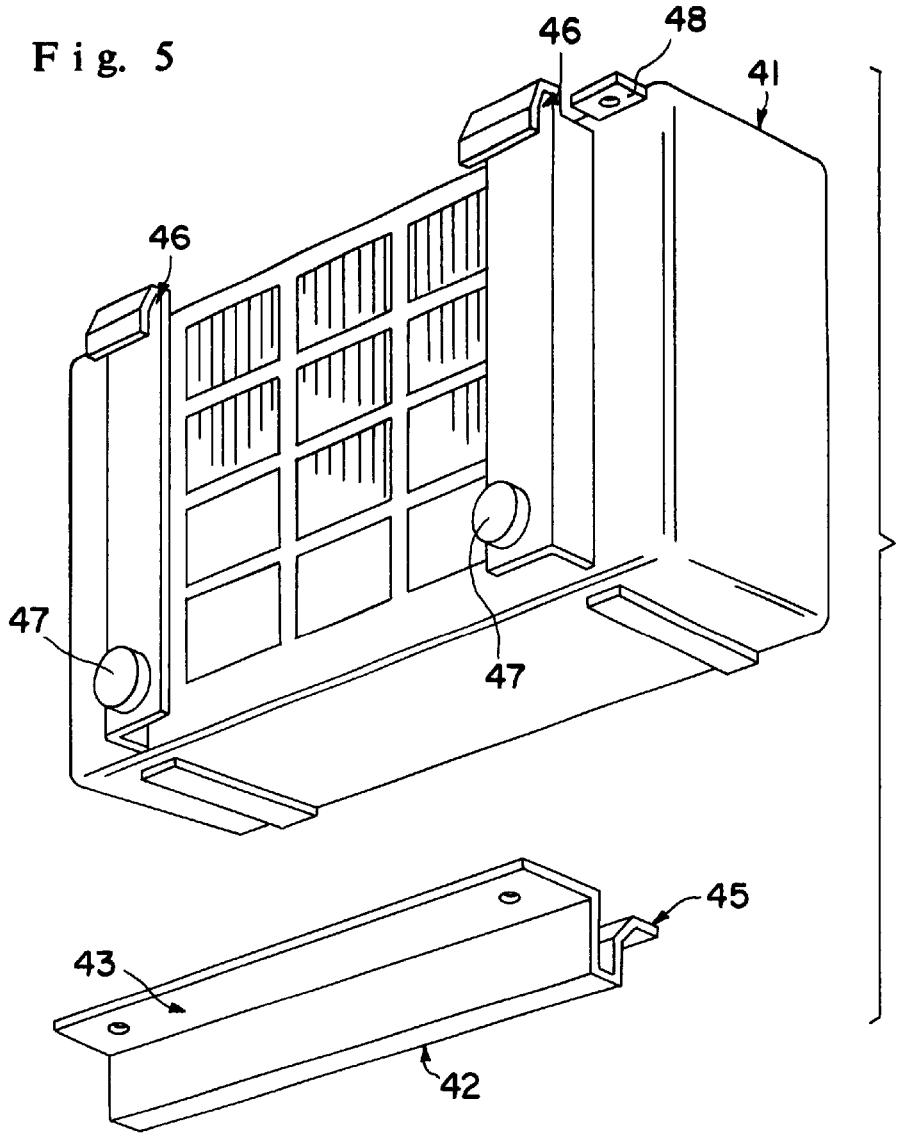
FIG. 5 is a backward perspective view of the prior art.
Figure 6:
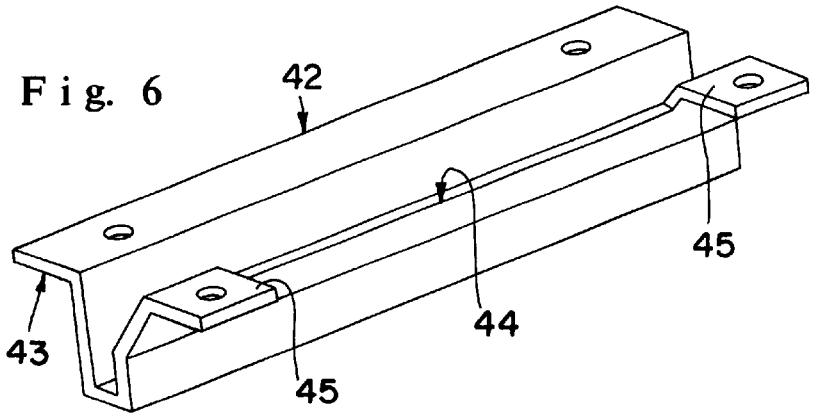
FIG. 6 is a forward perspective view of the prior art.
Figure 7:
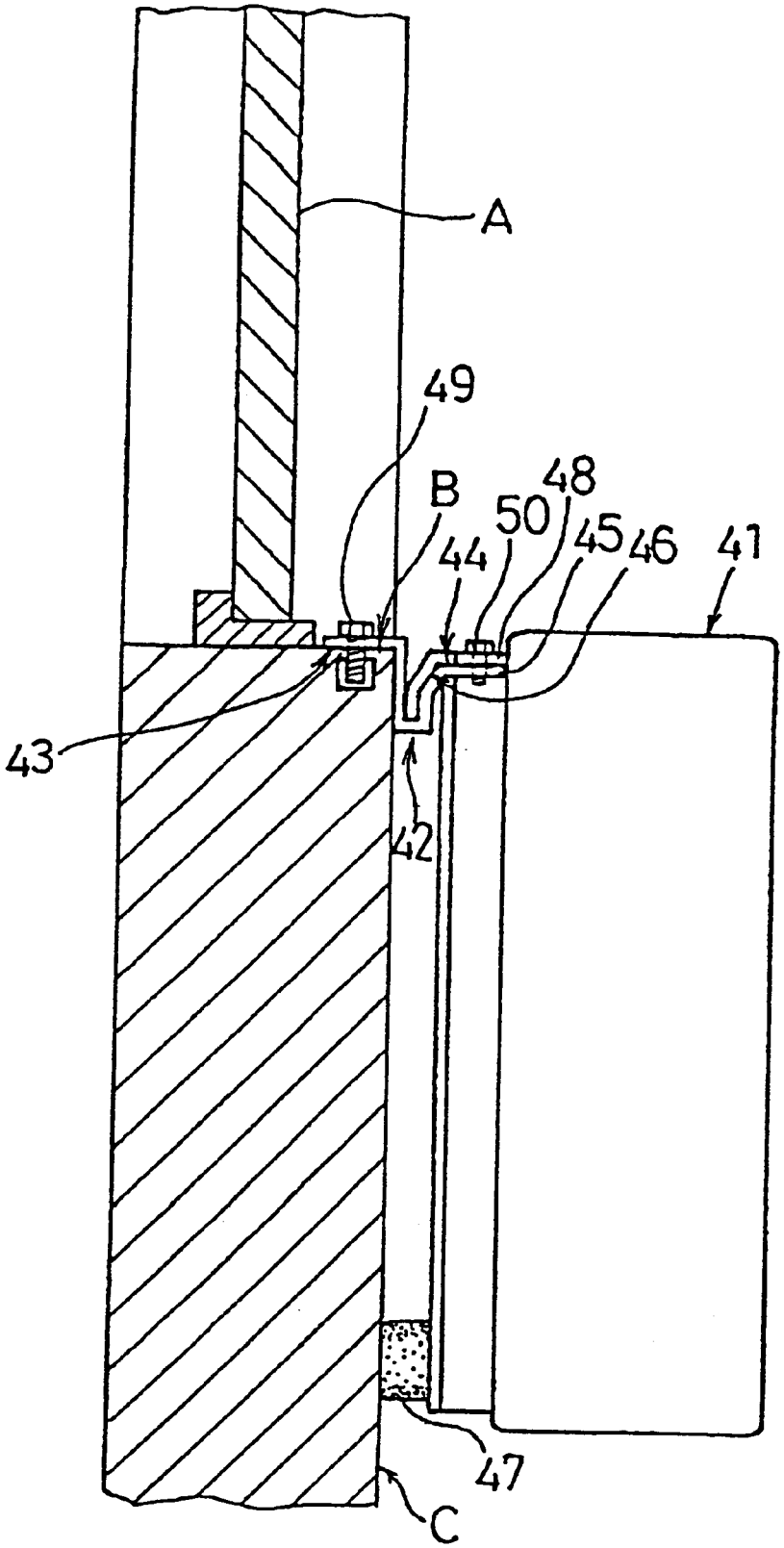
FIG. 7 is a sectional view of the prior art.
Figure 8:
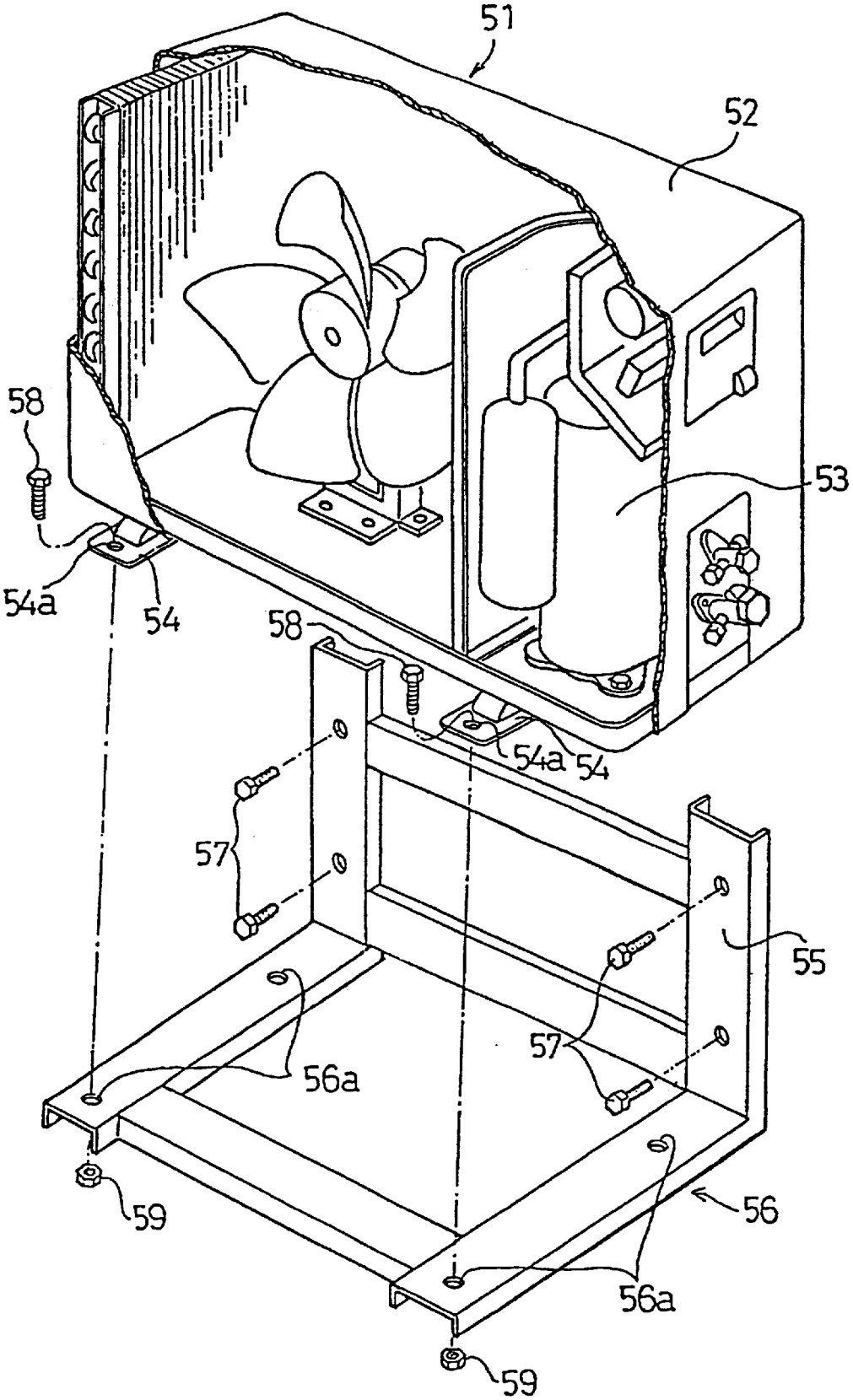
FIG. 8 is a perspective view of the prior art.

In the exemplary embodiment, after installing the unit 2 on the wall C, the ceiling plate 25 is bolted in the piping and wiring space 13, but it is not limited. As shown in FIG. 4, when using an installation tool 30 including a ceiling plate 28 serving also as the ceiling plate of the outdoor unit 2, installation and piping and wiring connection can be done without increasing the number of parts or the number of job steps, and also maintenance of the outdoor unit 2 and piping and wiring is easier. Therefore, it is particularly preferable for the outdoor unit 2 installed in a place easy to work from above, such as a position beneath the window. Moreover, by fastening the ceiling plate 28 between the installation tool 30 and the outdoor unit 2 by using screws 29, the strength of installation can be increased.

INDUSTRIAL APPLICABILITY

The present invention can be used for securing any unit to a vertical member. Securing an air conditioner unit to a wall is merely an exemplary useage for the present invention. By fitting this installation tool to a specified position of the vertical member at the yoke by using bolts, and then supporting the mounting part at the back side of the unit at the support part, the unit can be easily installed on a specified position of a wall. Later, if necessary to distribute the piping or wiring to the right and left side of the unit, without exposing the piping or wiring above or beneath the outdoor unit in the appearance from the D front side, the piping and/or wiring space can be distributed behind the outdoor unit. As a result, exposure of piping or wiring to rain and wind is lessened, and the appearance is improved.

In the constitution combined with a ceiling plate for covering the upper part of the piping and/or wiring space, since the range within the piping or wiring space is covered, exposure of piping or wiring to rain and wind is lessened more effectively, and the appearance from above is further improved.

In the constitution of using the ceiling plate which also covers above the outdoor unit, without increasing the number of parts or number of steps, the same effect and action as above are obtained.

In the constitution of disposing a recess for forming a space against the wall at the back side of the bolting portion of the yoke, the yoke is fitted to the wall with an elastic pressing force having a necessary pressing force by bolting and a low elasticity in the space formed against the wall. Accordingly, without using a rubber spacer, transmission of vibration of the outer unit supported on the support part to the indoor side through the wall can be reduced. Further, as compared with the use of rubber spacer or the like, this effect can be maintained for a longer period.

What is claimed is:

1. A unit installation tool installing a unit of a separate type air conditioner on a vertical member, comprising.

a yoke for fitting to said vertical member with bolts, and a support part extended forward from said yoke mounting an upper part of the back side of said unit on an end of said support part, said support part including a coupling, said back side of said unit including a first mounting part having a protrusion, said protrusion being connected to said support part such that said support part supports said unit, said coupling mechanically joining said mounting part and said support part, said support part defining conduit space, and a ceiling plate for covering the upper part of said conduit space.

2. The unit installation tool installing a unit of a separate type air conditioner of claim 1, wherein a recess for forming a further space against said vertical member is provided in a back side of a portion of said yoke.

3. A unit installation tool installing a unit of a separate type air conditioner on a vertical member, comprising a yoke for fitting to said vertical member with bolts, and a support part extended forward from said yoke mounting an upper part of the back side of said unit on an end of said support part, said support part including a coupling, said back side of said unit including a first mounting part having a protrusion, said protrusion being connected to said support part such that said support part supports said unit, said coupling mechanically joining said mounting part and said support part, said support part defining conduit space, and a ceiling plate is also for covering above said unit.

4. The unit installation tool installing a unit of a separate type air conditioner of claim 3 wherein a recess for forming a further space against said vertical member is provided in a back side of a portion of said yoke.

5. A unit installation tool installing a unit of a separate type air conditioner on a vertical member, said separate type air conditioner including a piping for connecting an outdoor unit and an indoor unit, comprising a yoke for fitting to said vertical member with bolts, and a recess for forming a further space against said vertical member is provided in a back side of a portion of said yoke, a support part extended forward from said yoke mounting an upper part of the back side of said unit on an end of said support part, said support part including a coupling, said back side of said unit including a first mounting part having a protrusion, said protrusion being connected to said support part such that said support part supports said unit, said coupling mechanically joining said mounting part and said support part, and a conduit space defined by said support part, and said conduit space adapted for said piping being installed therein.

6. A unit installation tool installing a unit of a separate type air conditioner on a vertical member, said separate type air conditioner including a piping for connecting an outdoor unit and an indoor unit, comprising:

(a) a yoke for abutting against said vertical member, (b) a first support part extended forward from said yoke supporting an upper part of a back side of said unit, said first support part including a coupling, said back side of said unit including a first mounting part having a protrusion, said protrusion being connected to said first support part such that said first support part supports said unit, said coupling mechanically joining said first mounting part and said first support part, and (c) a first space for being enclosed by said vertical member, said back side, and an upper side of said first support part, when said unit is installed on said vertical member, said first space capable of installing conduit and said piping therein.

7. The unit installation tool installing a unit of a separate type air conditioner of claim 6, wherein said yoke has a first through-hole, and said yoke is fixable to said wall by a first bolt penetrating through said first through-hole.

8. A unit installation tool for installing a unit of a separate type air conditioner on a vertical member comprising:

(a) a yoke for abutting against said vertical member, (b) a first support part extended forward from said yoke, for supporting an upper part of a back side of said unit, and (c) a first space for being enclosed by said vertical member, said back side, and an upper side of said first support part, when said unit is installed on said vertical member, capable of installing conduit, wherein said back side of said unit has a first mounting part having a protrusion, said first support part has a tightening part, and said protrusion is fitted to said tightening part so that said first support part may support said unit.

9. A unit installation tool installing a unit of a separate type air conditioner on a vertical member, said separate type air conditioner including a piping for connecting an outdoor unit and an indoor unit, comprising:

(a) a yoke for abutting against said vertical member, (b) a first support part extended forward from said yoke supporting an upper part of a back side of said unit, said first support part including a tightening part, said back side of said unit including a first mounting part having a protrusion, said protrusion is coupled to said tightening part whereby said first support part supports said unit; and (c) a first space for being enclosed by said vertical member, said back side, and an upper side of said first support part, when said unit is installed on said vertical member, said first space capable of installing conduit and said piping therein.

10. A unit installation tool installing a unit of a separate type air conditioner on a vertical member, comprising:

(a) a yoke for abutting against said vertical member, (b) a first support part extended forward from said yoke supporting an upper part of a back side of said unit, said first support part including a coupling, said back side of said unit including a first mounting part having a protrusion, said protrusion being connected to said first support part such that said first support part supports said unit, said coupling mechanically joining said first mounting part and said first support part, (c) a first space for being enclosed by said vertical member, said back side, and an upper side of said first support part, when said unit is installed on said vertical member, capable of installing conduit, and (d) a ceiling plate for covering said first space.

11. A unit installation tool for installing a unit of a separate type air conditioner on a vertical member comprising:

(a) a yoke for abutting against said vertical member, (b) a first support part extended forward from said yoke, for supporting an upper part of a back side of said unit, and (c) a first space for being enclosed by said vertical member, said back side, and an upper side of said first support part, when said unit is installed on said vertical member, capable of installing conduit, and (d) a ceiling plate for covering said first space, wherein said first support part has a tightening part folded in the upper direction, and a ceiling plate holding part folded at a right angle from said tightening part, and said ceiling plate fixed on the upper surface of said ceiling plate holding part.

12. A unit installation tool installing a unit of a separate type air conditioner on a vertical member, comprising:

(a) a yoke for abutting against said vertical member, (b) a first support part extended forward from said yoke supporting an upper part of a back side of said unit, said first support part including a coupling, said back side of said unit including a first mounting part having a protrusion, said protrusion being connected to said first support part such that said first support part supports said unit, said coupling mechanically joining said first mounting part and said first support part, (c) a first space for being enclosed by said vertical member, said back side, and an upper side of said first support-part, when said unit is installed on said vertical member, capable of installing conduit, and (d) a ceiling plate for covering said first space and for being above said unit.

13. A unit installation tool for installing a unit of a separate type air conditioner on a vertical member comprising:

(a) a yoke for abutting against said vertical member, (b) a first support part extended forward from said yoke, for supporting an upper part of a back side of said unit, and (c) a first space for being enclosed by said vertical member, said back side, and an upper side of said first support part, when said unit is installed on said vertical member, capable of installing conduit, wherein said yoke has a recess for forming a second space at the side of said vertical member, a first through-hole is formed in said recess, and said yoke being adaptable for being fixed to said vertical wall by a first bolt penetrating said first through-hole through said second space.

14. A unit installation tool for installing a unit of a separate type air conditioner on a vertical member, said separate type air conditioner including a piping or connecting an outdoor unit and an indoor unit, comprising:

(a) a yoke for abutting against said vertical member, (b) a first support part extended forward from said yoke for supporting an upper part of a back side of said unit, (c) a first space for being enclosed by said vertical member, said back side, and an upper side of said first support part, when said unit is installed on said vertical member, said first space capable of installing conduit and said piping therein, and (d) a second support part having a shape extended forward from said yoke, for defining a lower position of said back side of said unit.

15. A unit installation tool for installing a unit of a separate type air conditioner on a vertical member comprising:

(a) a yoke for abutting against said vertical member, (b) a first support part extended forward from said yoke, for supporting an upper part of a back side of said unit, and (c) a first space for being enclosed by said vertical member, said back side, and an upper side of said first support part, when said unit is installed on said vertical member, capable of installing conduit, and (d) a second support part having a shape extended forward from said yoke, for defining a lower position of said back side of said unit, wherein said second support part has a third through-hole, and said unit installation tool is adapted for installing a unit having a second hole formed in a second mounting part at a position corresponding to said third through-hole, and said second mounting part fixable by a third bolt secured into said second hole by way of said third through-hole.

16. A method for installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke, for supporting an upper part of a back side of said unit, and (3) a first space enclosed by said vertical member, said back side, and an upper side of said first support part, when said unit is installed on said vertical member, capable of installing conduit, (c) fixing said yoke to said vertical member, a first bolt is bonded into a first hole formed in said vertical member by penetrating a first through-hole formed in, said yoke, and said mounting part is fixed to said vertical member, (d) fitting said first mounting part to said first support part, and holding said unit on said installation tool, and (e) installing said conduit in said first space.

17. A method for installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke, for supporting an upper part of a back side of said unit, and (3) a first space enclosed by said vertical member, said back side, and an upper side of said first support part, when said unit is installed on said vertical member, capable of installing conduit, (c) fixing said yoke to said vertical member, (d) fitting said first mounting part to said first support part, and holding said unit on said installation tool, and (e) installing said conduit in said first space, wherein said back side of said unit has a first mounting part having a protrusion, said first support part has a tightening part folded in the upper direction, and at said step (d), said protrusion is fitted to said tightening part, and said unit is supported on said first support part.

18. The installation method of claim 17, further comprising the step of:

(f) installing a ceiling plate covering said first space.

19. A method for installing a unit of a separate type air conditioner on a vertical member, said separate type air conditioner including a piping for connecting an outdoor unit and an indoor unit, comprising the steps of:

(a) supplying said unit having a first mounting part at a back side of said unit, said first mounting part including a protrusion, (b) supplying an installation tool for mounting said unit on said vertical member, said installation tool including:

(1) a yoke fixed to said vertical member, (2) a first support part extended forward from said yoke for supporting an upper part of said back side of said unit, said first support part including a tightening part folded in the upper direction, and (3) a first space enclosed by said vertical member, said back side, and an upper side of said first support part, when said unit is installed on said vertical member, said first space capable of installing conduit and said piping therein, (c) fixing said yoke to said vertical member, (d) fitting aid first mounting part to said first support part by coupling said protrusion to said tightening part whereby said unit is supported on said first support part, and holding said unit on said installation tool, and (e) installing said conduit in said first space.

20. A method installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke supporting an upper part of a back side of said unit, said first support part including a coupling extending in an upward direction, said back side of said unit including a first mounting part having a protrusion, (3) a first space enclosed by said vertical member, said back side, and an upper side of said first support part, when said unit is installed on said vertical member, capable of installing conduit, (c) fixing said yoke to said vertical member, and connecting said protrusion to said first support part such that said first support part supports said unit, said coupling mechanically joining said first mounting part and said first support part, (d) fitting said first mounting part to said first support part, and holding said unit on said installation tool, (e) installing said conduit in said first space, and (f) installing a ceiling plate covering said first space.

21. A method installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke supporting an upper part of a back side of said unit, said first support part including a coupling extending in an upward direction, said back side of said unit including a first mounting part having a protrusion, (3) a first space enclosed by said vertical member, said back side, and an upper side of said first support part, when said unit is installed on said vertical member, capable of installing conduit, (c) fixing said yoke to said vertical member, and connecting said protrusion to said first support part such that said first support part supports said unit, said coupling mechanically joining said first mounting part and said first support part, (d) fitting said first mounting part to said first support part, and holding said unit on said installation tool, (e) installing said conduit in said first space, and (f) installing a ceiling plate covering said first space and above said unit.

22. A method for installing a unit of a separate type air conditioner on a vertical member, said separate type air conditioner including a piping for connecting an outdoor unit and an indoor unit, comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke, for supporting an upper part of a back side of said unit, and (3) a first space enclosed by said vertical member, said back side, and an upper side of said first support part, when said unit is installed on said vertical member, said first space capable of installing conduit and said piping therein, (c) fixing said yoke to said vertical member, said yoke including a recess for forming a second space at a side of said vertical member, said recess including a first through-hole, said yoke is fixed to said vertical member by a first bolt penetrating said first through-hole through said second space, (d) fitting said first mounting part to said first support part, and holding said unit on said installation tool, and (e) installing said conduit in said first space.

23. A method for installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke, for supporting an upper part of a back side of said unit, and (3) a first space enclosed by said vertical member, said back side, and an upper side of said first support part, when said unit is installed on said vertical member, capable of installing conduit, (c) fixing said yoke to said vertical member, (d) fitting said first mounting part to said first support part, and holding said unit on said installation tool, (e) installing said conduit in said first space, and (f) fixing a second support part having a shape extended forward from said yoke, on a second mounting part disposed at a lower position of said back side of said unit.

24. A method for installing a unit of a separate type air conditioner on a vertical member comprising the steps of:

(a) supplying said unit having a first mounting part at its back side, (b) supplying an installation tool for mounting said unit on said vertical member, said installation tool including:

(1) a yoke fixed to said vertical member, (2) a first support part extended forward from said yoke, for supporting an upper part of a back side of said unit, and (3) a first space enclosed by said vertical member, said back side, and an upper side of said first support part, when said unit is installed on said vertical member, capable of installing conduit, (c) fixing said yoke to said vertical member, (d) fitting said first mounting part to said first support part, and holding said unit on said installation tool, (e) installing said conduit in said first space, and (f) fixing a second support part having a shape extended forward from said yoke, on a second mounting part disposed at a lower position of said back side of said unit, wherein said second support part has a third through-hole, said unit has a second hole formed in a second mounting part at a position corresponding to said third through-hole, and the second mounting part of said unit is fixed to said second support part by a third bolt bonded into said second fixing hole by way of said third through-hole.

* * * * *

UNITED STATES PATENT AND TRADEMARK OFFICE

CERTIFICATE OF CORRECTION

PATENT NO. : 6,354,555 B1 
DATED : March 12, 2002
INVENTOR(S) : Toshiharu Nishizuka, Koji Hatano and Mitsuo Nakanuma It is certified that error appears in the above-identified patent and that said Letters Patent is hereby corrected as shown below:

Title page,
Item [56], References Cited, FOREIGN PATENT DOCUMENTS,
add the following:

-- JP S53-061252 5/1978 --.

Column 8,
Line 47, please delete "or" and insert -- for --.

Column 9,
Line 31, please delete "a first bolt is bounded into a first hole formed in said vertical member by penetrating a first through-hole formed in, said yoke, and said mounting part is fixed to said vertical member".

Signed and Sealed this

Twenty-fourth Day of December, 2002

JAMES E. ROGAN
*Director of the United States Patent and Trademark Office*